US005100023A

United States Patent [19]

Varian et al.

[11] Patent Number: 5,100,023

[45] Date of Patent: Mar. 31, 1992

[54] RIVET DELIVERY DEVICE

[75] Inventors: Raymond H. Varian, Fairfield; Donald Viscio, Danbury, both of Conn.

[73] Assignee: Emhart Inc., Newark, Del.

[21] Appl. No.: 619,076

[22] Filed: Nov. 28, 1990

[51] Int. Cl.[5] ..... B23Q 7/00

[52] U.S. Cl. ..... 221/239; 221/258; 221/262

[58] Field of Search ..... 221/211, 224, 239, 258, 221/272-273, 262; 227/114-118, 112, 104, 107, 139

[56] References Cited

U.S. PATENT DOCUMENTS

| | | | |
|---|---|---|---|
| 3,717,023 | 2/1973 | Prosser et al. | 227/114 |
| 3,926,356 | 12/1975 | Still | 227/114 |
| 4,463,889 | 8/1984 | Sartran | 221/233 |
| 4,620,656 | 11/1986 | McClay et al. | 221/64 |
| 4,643,344 | 2/1987 | Kaita et al. | 221/224 |
| 4,645,112 | 2/1987 | Davern et al. | 221/248 |
| 4,720,215 | 1/1988 | Arena | 221/175 |

*Primary Examiner*—David H. Bollinger
*Attorney, Agent, or Firm*—Spencer T. Smith

[57] ABSTRACT

A pneumatic actuator includes an splined shaft which cooperates with a cam follower so that displacement of the shaft is purely axial for a substantial portion of its forward displacement but the final displacement portion rotates the follower and hence the transfer arm.

3 Claims, 1 Drawing Sheet

RIVET DELIVERY DEVICE

The present invention relates to automated systems for setting blind rivets.

Basic to an automated system is the ability to feed rivets to the rivet setting tool. One technique relies on a delivery device which receives the next rivet, carries this rivet in an axial direction to a location beyond the nose of the rivet tool and then pivots the rivet to present the rivet in coaxial alignment with the nose so that transfer can take place.

It is an object of the present invention to provide a delivery device that will efficiently perform these functions.

Other objects and advantages of the present invention will become apparent from the following portion of this specification and from the accompanying drawings which illustrates in accordance with the mandate of the patent statutes a presently preferred embodiment incorporating the principles of the invention.

Referring to the drawing:

FIG. 1 presents an oblique view of a rivet setting tool having a rivet delivery device made in accordance with the teachings of the present invention;

Figure 1:
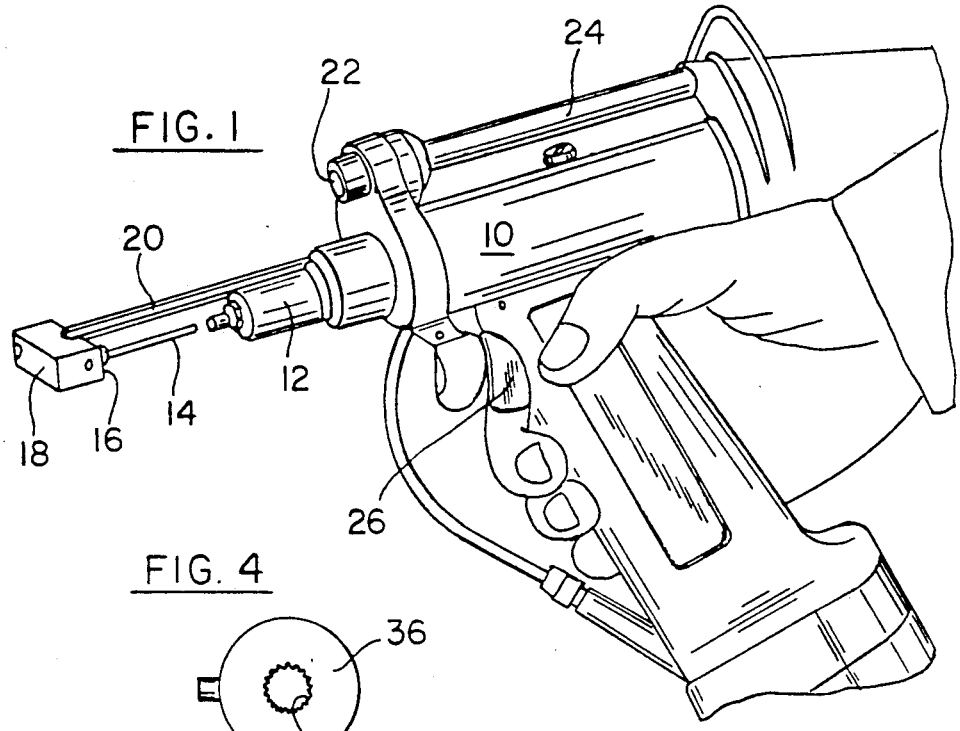
Figure 4:
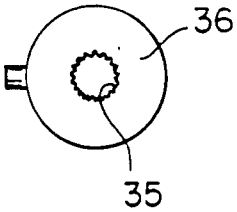
FIG. 4 shows the internally axially grooved bore of the cylindrical follower.
Figure 2:
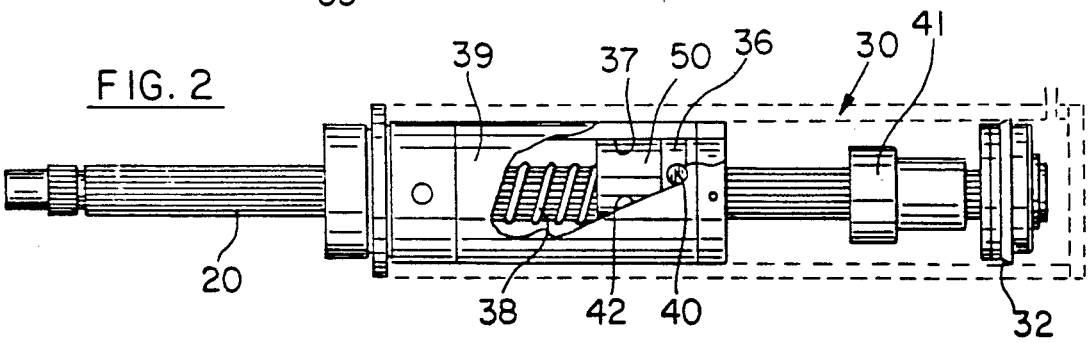
FIG. 2 is side elevational view of a portion of the rivet delivery device shown in FIG. 1.

A rivet setting tool 10 has a nose 12 which is to receive a blind rivet 14. The blind rivet is presented in coaxial relation with the nose by the nesting bushing 16 of a transfer arm 18 which is secured at the end of a splined shaft 20. To transfer the blind rivet, pressure is applied to the nesting bushing to blow the blind rivet across the separation into the nose. The transfer arm is then rotated counterclockwise about 30° and the splined shaft is axially retracted until the nesting bushing is adjacent the end 22 of the feed tube 24 so that the next blind rivet can be delivered to the nesting bushing where it will be held under vacuum until it is transferred to the nose. When the blind rivet in the tool is set and the trigger 26 is released, the splined shaft will be axially advanced and pivoted to again locate the transfer arm at the transfer position to repeat the cycle.

Figure 3:
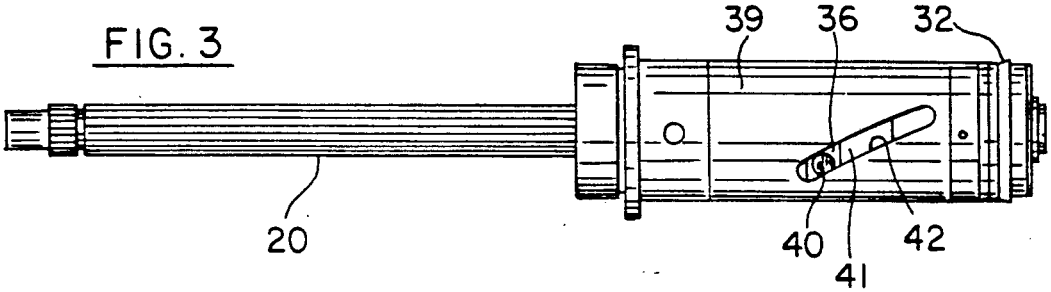
FIG. 3 is a view similar to that of FIG. 2 with the shaft fully extended.

To effect these movements, a pneumatic actuator is provided which has a cylindrical housing 30 in which is displaceably located a piston 32 including the axially splined shaft 20. The splined shaft 20 is matingly received by an internally axially grooved bore 35 in a cylindrical follower 36 which is slidingly received within the bore 37 of a cylindrical cam 39. Displacement of the piston under pressure towards the left will axially advance the splined shaft and hence the transfer arm. When the pusher 41 which is secured to the splined shaft 20 adjacent the piston 32 is advanced a selected distance into engagement with the follower 36, the follower will be forcefully advanced in opposition to the compression spring 38 and will pivot about the axis as defined by the movement of the follower pin 40 in the cam slot 42 as the piston completes its stroke. Advancement of the shaft will stop when the piston engages the rear end of the cam (FIG. 3). The transfer arm will have been advanced and pivoted from the feed position to the transfer position. To maintain the right hand end of the compression spring within the cam, it is positioned within a plastic guide 50. When pressure is removed from the actuator and vacuum is applied the transfer arm is pivoted and retracted from its transfer position to the feed position.

What is claimed is:

1. A pneumatic actuator for transferring a blind rivet from a pick up location to a delivery location comprising, a piston and rod assembly including a rod having an axial spline, a piston secured at one end of said rod, a pusher element secured on said rod adjacent said piston, and a transfer arm secured on the other end of said rod for receiving a blind rivet at the pick up location and for delivering the blind rivet at the delivery location, housing means for slideably receiving said piston and rod assembly, said piston and rod assembly being selectively displaceable between retracted and advanced positions, said housing means including cylindrical cam means, said cylindrical cam means being open at one end to permit axial displacement of said pusher element thereinto, said open end comprising means for stopping the forward displacement of said piston at said advanced position, said cylindrical cam means having a cam track inclined to the axis of said rod, a cam follower axially displaceable within said cylindrical cam means, said cam follower having an internally grooved axial bore for matingly receiving said splined rod and having a pin for following said cam track, compression spring means for urging said cam follower rearwardly to locate said pin at one end of said cam track, the axial separation between said pusher element and said cam follower when said piston is at said retracted position being selected so that said transfer arm can be axially advanced a predetermined distance to a partially advanced location without pivotal movement and the axial separation between the front of said piston which will engage said open end of said cylindrical cam means and the front of said pusher element which will engage said cam follower being selected so that said cam pin will be displaced along said cam track from said one end to pivot said transfer arm a predetermined number of degrees as said piston is displaced from said partially advanced position to said advanced position.

2. A device for delivering a blind rivet according to claim 1 further comprising a guide bushing for receiving the end of said compression spring adjacent said cam follower.

3. A device for delivering a blind rivet according to claim 1, wherein said transfer arm includes a nesting bushing.

* * * * *